US005406885A

United States Patent [19]

Privin

[11] Patent Number: 5,406,885

[45] Date of Patent: Apr. 18, 1995

[54] INKING CARTRIDGE

[75] Inventor: David Privin, Stamford, Conn.

[73] Assignee: Pitney Bowes Inc., Stamford, Conn.

[21] Appl. No.: 703,315

[22] Filed: May 20, 1991

[51] Int. Cl.[6] ..... B41F 31/30

[52] U.S. Cl. ..... 101/348; 101/103

[58] Field of Search ..... 101/103, 348, 298, 301, 101/314, 315, 335, 349, 350, 309, 320, 323, 363, 367, 331

[56] References Cited

U.S. PATENT DOCUMENTS

| | | | |
|---|---|---|---|
| 3,229,631 | 1/1966 | Peterson | 101/228 |
| 3,491,685 | 1/1970 | Tramposch | 101/367 X |
| 3,797,388 | 3/1974 | Kaminstein | 101/367 X |
| 3,812,782 | 5/1974 | Funahashi | 101/367 |
| 4,044,677 | 8/1977 | Hamisch, Jr. | 101/348 |
| 4,273,046 | 6/1981 | Sato | 101/295 X |
| 4,440,083 | 4/1984 | Hooper | 101/103 X |
| 4,697,517 | 10/1987 | Fassman et al. | 101/103 X |

*Primary Examiner*—J. Reed Fisher

*Attorney, Agent, or Firm*—Melvin J. Scolnick; David E. Pitchenik; Steven J. Shapiro

[57] ABSTRACT

A disposable inking cartridge adapted to be removably connected to a mailing machine, the cartridge comprising: a generally rectangularly-shaped hollow housing having opposed side walls and having an edge wall extending between the side walls, the walls defining an aperture formed in the housing; an ink impregnated reservoir roller extending between the side walls and supported thereby for rotation about a first predetermined axis; an ink impregnated transfer roller extending between the side walls and supported thereby for rotation about a second predetermined axis extending parallel to the first axis; and the reservoir and transfer rollers respectively dimensioned for rolling engagement with each other to cause ink from the reservoir roller to be transferred to the transfer roller, and the transfer roller disposed within the housing to permit peripheral access thereto via the housing aperture.

12 Claims, 3 Drawing Sheets

INKING CARTRIDGE

BACKGROUND OF THE INVENTION

This invention is generally concerned with an inking cartridge and more particularly with a disposable inking cartridge which is removably mountable in a mailing machine.

This application is one of the following three (3) related, concurrently filed, U.S. patent applications filed by the same inventor, i.e. David Privin, and assigned to the same assignee: Ser. No. 703,316 for a Mailing Machine Having A Disposable Inking Cartridge, (Assignee file C-789); Ser. No. 703,315 for an Inking Cartridge, (Assignee file (C-790); and Ser. No. 703,306, now U.S. Pat. 5,353,700, for a Mailing Machine Including Movable Inking Cartridge, (Assignee file C-791).

In U.S. Pat. No. 4,440,083 for a Disposable Inking Cartridge issued Apr. 3, 1984 to Clinton E. Hopper and assigned to the assignee of the present invention, there is disclosed a disposable inking cartridge which is constructed and arranged to be removably connected to a mailing machine. The inking cartridge includes an ink impregnated roller, known in the art as a reservoir roller. The mailing machine includes a rotary postage printing drum and includes an ink impregnated roller known in the art as a transfer roller. The reservoir roller is disposed in rolling engagement with the mailing machine's transfer roller when the cartridge is connected to the mailing machine. And, when the mailing machine is operated, the printing drum rotates into engagement with the transfer roller for transferring ink from the reservoir roller to the transfer roller, and from the transfer roller to the printing drum.

Since the ink transfer roller is a component of the mailing machine, when the inking cartridge is replaced to provide a new reservoir roller, old residual ink carried by the ink transfer roller is mixed with ink from the new reservoir roller when it is transferred to the printing drum. Accordingly, the Hopper inking system is limited to providing replacement inking cartridges having reservoir rollers which are impregnated with the same color of ink as previously used in the system. Further, the Hopper inking system is generally limited to utilization of an ink having the same chemical formula as the ink previously used in the system, in order preclude the possibility of a chemical reaction between new reservoir roller ink and the old transfer roller ink. Moreover, the Hopper inking system does not account for aging, or wear and tear, of the ink transfer roller, which may result in unevenly transferring ink to the printing drum, or smearing ink thereon, whether or not a new reservoir roller is provided. And, customers have been found to be disappointed when a new reservoir roller is provided, due to not receiving an immediate significant enhancement of the quality of printing provided by the printing drum, inasmuch as the volume of residual ink impregnating the transfer roller is normally substantially reduced prior to the provision of the new reservoir roller and is only gradually increased thereafter as the new reservoir roller is used.

In addition to the foregoing, conventional wisdom in the mailing machine arts dictates that reservoir rollers be less dense, and thus less porous, than transfer rollers, to promote the transfer of ink, by capillary action, from the reservoir roller to the transfer roller when the rollers are at rest, to ensure that the transfer roller is sufficiently impregnated with ink when the printing drum rotates in engagement therewith to appropriately wet the drum for printing purposes. On the other hand, it has been found that the transfer roller may become so saturated with ink that it tends to migrate from the transfer roller to other components of the mailing machine and excessively wet the printing drum.

Accordingly:

an object of the invention is to provide an improved inking system for use in letter processing apparatus;

another object is to provide a disposable inking cartridge which includes both a reservoir roller and a transfer roller; and another object is to provide a disposable inking cartridge adapted to be removably connected to a mailing machine for use therein.

SUMMARY OF THE INVENTION

A disposable inking cartridge adapted to be removably connected to a mailing machine, the cartridge comprising: a generally rectangularly-shaped hollow housing having opposed side walls and having an edge wall extending between the side walls, the walls defining an aperture formed in the housing; an ink impregnated reservoir roller extending between the side walls and supported thereby for rotation about a first predetermined axis; an ink impregnated transfer roller extending between the side walls and supported thereby for rotation about a second predetermined axis extending parallel to the first axis; and the reservoir and transfer rollers respectively dimensioned for rolling engagement with each other to cause ink from the reservoir roller to be transferred to the transfer roller, and the transfer roller disposed within the housing to permit peripheral access thereto via the housing aperture.

BRIEF DESCRIPTION OF THE DRAWINGS

As shown in the drawings wherein like references numerals designate like or corresponding parts throughout the several views.

DESCRIPTION OF THE PREFERRED EMBODIMENTS

Figure 1:
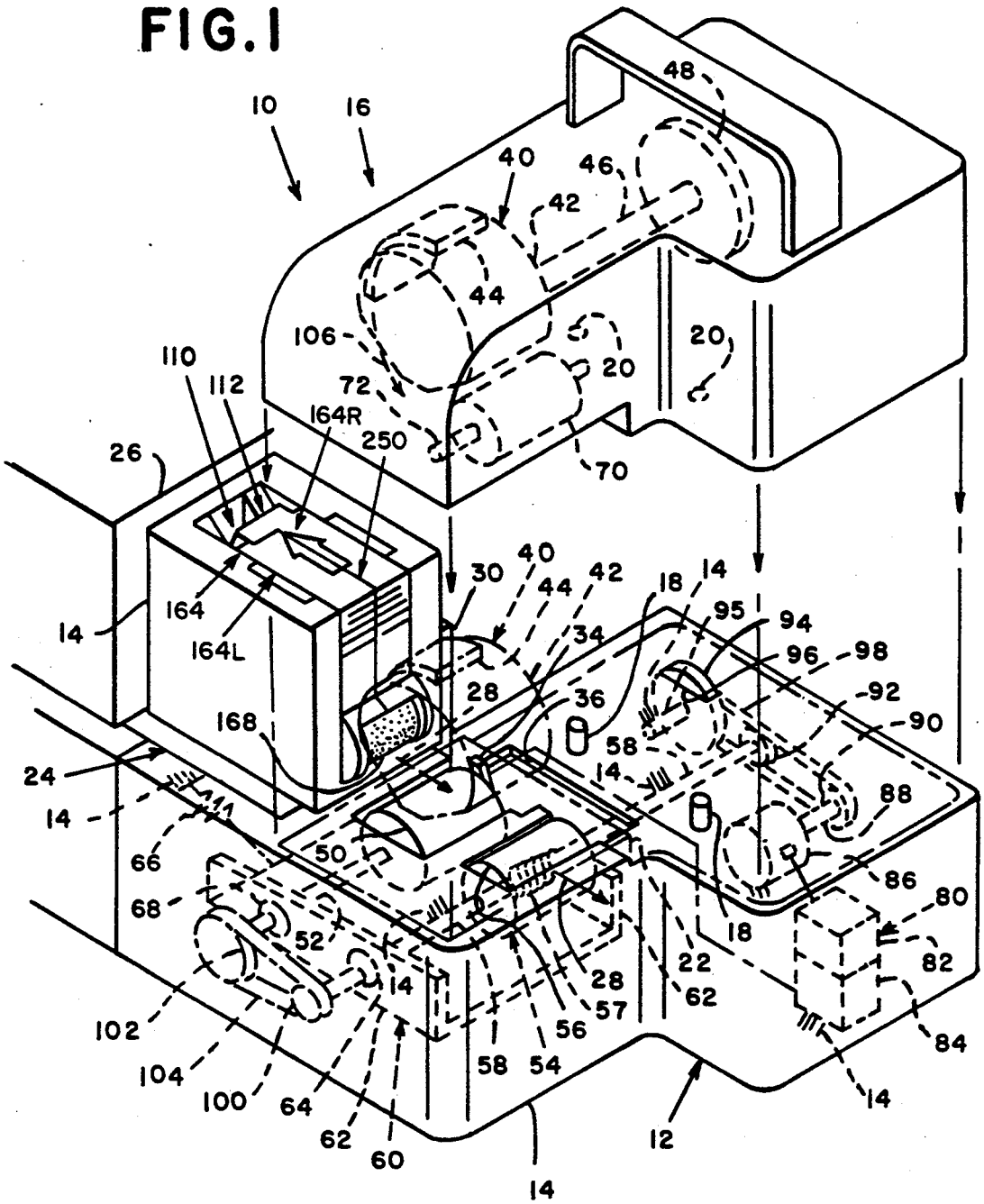
FIG. 1 is a partially fragmented, partially exploded, perspective view of a mailing machine comprising a removably mountable inking cartridge, including a transfer roller, and a removably mountable postage meter, including a printing drum having a printing die.

As shown in FIG. 1, letter processing apparatus in which the invention may be incorporated comprises a mailing machine 10, including a base 12 having a housing 14, and including a postage meter 16 removably mountable on the base 12. The base 12 includes a plurality of posts 18 and the meter 16 includes a like number of apertures 20 dimensioned for engagement with the posts 18 for guiding and positioning the meter 16 relative to the base 12. When mounted on the base 12, the postage meter 16 forms therewith a slot 22, through which letters 24 are fed to the machine 10, either by hand or by means of suitable feeding apparatus 26, for feeding thereby in a downstream path of travel 28. The base 12 additionally comprises a letter edge registration fence 30, and comprises structure for sensing letters 24 fed to the machine 10, including a trip lever 34 which extends upwardly through a housing aperture 36 and into the path of travel 28 of letters 24 fed to the machine 10.

The postage meter 16 (FIG. 1) comprises printing structure 40 including a rotary printing drum 42 having, inter alia, a conventional postage printing die 44 peripherally extending therefrom for engaging and feeding letters 24 downstream in the path of travel 28 while printing postage indicia thereon. In addition, the meter 16 includes a shaft 46, extending from the drum 42, and a drive gear 48, mounted on the shaft 46 for rotation thereof and thus of the printing structure 40.

The base 12 (FIG. 1) includes a conventional impression roller 50 and a shaft 52 on which the impression roller 50 is mounted for rotation. The shaft 52 is yieldably connected to the housing 14 so as to extend upwardly through the housing aperture 36, and into the path of travel 28, for urging mixed therefrom letters 24 into printing engagement with the printing die 44. The base 12 additionally includes a conventional ejection roller 54, which includes a cylindrically-shaped outer member 56 and a coaxially-extending coil spring 57 having one end connected thereto. And the base 12 includes an drive shaft 58; extending coaxially of the roller 54, on which the outer roller member 56 is rotatably mounted and to which the other end of the spring 57 is connected.

For yieldably connecting the impression roller 50 (FIG. 1) to the housing 14, the base 12 may include any suitable structure 60, such as a pair of parallel-spaced, interconnected, pivot arms 62 having one end thereof conventionally rotatably connected to the ejection roller shaft 58 as by means of bearings 64, and having the other ends resiliently connected to the housing 14, by means of a depending spring 66, and provided with bearings 68 for rotatably supporting the impression roller shaft 50. Further, the postage meter 16 preferably includes a suitable idler roller 70, conventionally mounted for rotation on a shaft 72 which is suitably yieldably mounted to support the roller 70 above the ejection roller 54 for receiving therebetween mixed thickness letters 24.

In addition, the base 12 (FIG. 1) includes an intermittently operable system 80 for driving the drum drive gear 48, and thus the drum 42, the impression roller shaft 52, and thus the impression roller 50, and the ejection roller shaft 58, in timed relationship with one another in response to movement of the trip lever 34 by a letter 24 fed to the machine 10. The driving system 80 includes suitable control structure 82 and trip structure 84, which are respectively conventionally connected to the housing 14. The trip structure 84 is suitably connected between the trip lever 34 and control structure 82 for providing conventional input thereto indicative that a letter 24 has been fed to the machine 10. The drive system 80 also includes a motor 86, which is conventionally connected to the control structure 82 for operation thereof in response to conventional input from the trip structure 84, and which has an output shaft 88. In addition, the drive system 80 includes a pinion gear 90, mounted on the output shaft 88, and a drive gear 92, mounted on the ejection roller shaft 58. Further the drive system 80 includes a drive gear 94, which is conventionally rotatably connected to the housing 14, as by means of a shaft 95 suitably rotatably connected thereto, and protrudes upwardly therefrom through an aperture 96 formed in the housing 14 for disposition in meshing engagement with the drum drive gear 48 when the postage meter 16 is mounted on the base 12. Moreover, the drive system 80 includes a drive gear (not shown), which is conventionally fixedly attached to the drive gear 94, and a gear belt 98 looped thereabout and about the pinion gear 90 for transmitting motor drive from the pinion gear 90 to the drive gear 94, and thus to the postage meter drum 42. Still further, the drive gear 92 is disposed in meshing engagement with the gear belt 98 for transmitting motor drive therefrom to the drive gear 92, and thus to the ejection roller shaft 58. The drive system 80 also includes a driven gear 100 mounted on the ejection roller shaft 58, a drive gear 102 mounted on the impression roller shaft 52, and a gear belt 104 which is looped about the gears, 100 and 102, for transmitting motor drive from the ejection roller shaft 58 to the impression roller shaft 52, and thus to the impression roller 50.

In operation, when a letter 24 (FIG. 1) is fed to the base 12, an edge thereof is urged into engagement with the registration fence 30 for guiding the letter 24 downstream in the path of travel 28, into the slot 22 between the base 12 and postage meter 16, and thus into engagement with the trip lever 34. The force exerted by the letter 24 against the trip lever 34 causes the lever 34 to move. Whereupon, the trip structure 84 causes the control system to energize the motor 86 for rotating the postage printing structure 40 through a single revolution. Upon energization of the motor 86, the motor output shaft 88 drives the pinion gear 90, thereby driving the gear belt 98 for rotating the ejector roller shaft 58, impression roller 50 and postage printing structure 40. As the impression roller 50 feeds the letter 24 downstream in the path of travel 28 beneath the drum 42, the printing die 44 rotates through a predetermined circularly-extending path of travel 106 and into engagement with the letter 24, followed by cooperating with the impression roller 50 to feed the letter 24 therebetween and to the ejection and idler rollers, 56 and 70, as the printing die 44 prints postage indicia on the letter 24. Thereafter, the ejection roller 56 also feeds the letter 24 downstream in the path of travel 28, and, in addition, stores excess energy in the ejection roller spring 57 until the upstream, trailing edge of the letter 24 is released due to the drum 42 rotating out of engagement with the letter 24. Whereupon, the excess energy stored in the ejection roller spring 57 rapidly rotates the outer roller member 56 in engagement with the letter 24, for ejecting the letter 24 from the machine 10.

According to the invention, the base 12 (FIG. 1) and thus the mailing machine 10, also includes a receptacle 110, formed in the housing 14, and a disposable inking cartridge 112, removably mountable in the receptacle 110.

The receptacle 110 (FIG. 2) is preferably an elongate, substantially vertically oriented slot-like cavity defined in the housing 14 by mean of a lower wall 114, and by means of a rear wall 116 and oppositely facing side walls 118 which respectively extend upwardly from the lower wall 114 and define an open upper end 120, opposite the lower wall 114, and a front opening 122, opposite the rear wall 116. The lower wall 114 preferably includes a T-shaped channel 124 formed therein, including a laterally-extending front portion 126, intersected by an elongate, rearwardly-extending, rear portion 128, having a pair of elongate oppositely facing side surfaces 130. In addition, the lower wall 114 includes a pair of elongate, parallel-spaced, horizontally-extending base surfaces 132, from which the channel side surfaces 130 downwardly extend. The rear wall 116 includes a vertically-extending lower portion 136, having a rectangularly-shaped aperture 138 formed therein. In addition, the rear wall 116 includes an upper portion 140, which is inclined upwardly and rearwardly from the lower portion 136 to the receptacle's upper open end 120, and has a slot 142 formed downwardly and rearwardly therein. The opposed side walls 118 each include a substantially L-shaped channel 144 formed therein, having a vertically extending leg 146 defined by oppositely facing side surfaces, 148 and 150, and having a horizontally extending leg 152 defined by an upper, horizontally-extending, lip surface 154 and by one of the lower wall base surfaces 132. In addition, each of the opposed side walls 118 includes a stop surface 156 which vertically extends between the lip and base surfaces, 154 and 132.

The cartridge 112 (FIG. 2) generally includes a hollow housing 164 having rotatably mounted therein an ink impregnated reservoir roller 166 (FIG. 3) and an ink impregnated transfer roller 168. The housing 164 (FIG. 2) is preferably an elongate, upright, generally rectangularly-shaped, structure, having opposed, upright side walls 172, and having an elongate perimeter edge wall 174 which extends between the side walls 172. The rollers, 161 and 168 (FIG. 3) respectively extend between the side walls 172, are rotatably connected thereto and are disposed in rolling engagement with one another. The edge wall 174 (FIG. 2) includes upper and lower edge portions, 175 and 176, and includes oppositely spaced front and rear edge portions, 178 and 180, extending between the upper and lower edge portions, 175 and 176. And, the front edge wall portion 178 has a generally arcuately-shaped aperture 182 formed therein via which the transfer roller 168 is peripherally accessible. As thus constructed and arranged, when the cartridge 112 (FIG. 1) is mounted in the receptacle 110, the transfer roller 168 is disposed for rolling engagement by the postage printing die 44 as the die 44 rotates into engagement with respective letters 24 in the path of travel 28.

For guiding manual insertion of the inking cartridge 112 (FIG. 2) into the receptacle 110, each of the side walls 172 includes an elongate, upright, generally rectangularly-shaped ridge 184 formed therein, substantially midway between the front and rear edge portions, 178 and 180, so as to extend laterally outwardly of the housing 164. Each of the ridges 184 has opposed, elongate, upright, parallel-spaced, front and rear guide edges, 186 and 188, and has an upper guide edge 190 extending transversely between the front and rear guide edges, 186 and 188. In addition, each of the ridges 184 has a V-shaped, downwardly pointing, lower guide edge 192, extending between the front and rear guide edges, 186 and 188, for visually indicating the direction of insertion, and guiding insertion, of the housing 164, and thus the cartridge 112, into the receptacle 110. The cartridge 112 additionally includes spring structure 192 comprising an elongate, generally rectangularly-shaped, leaf spring 194, which is fixedly connected to or integrally formed with the housing 164 and has a free end 196. Preferably, the leaf spring 192 is integrally formed with the upper edge wall portion 175 of the housing 164 so as to extend outwardly thereof and downwardly therefrom, alongside of the rear edge wall portion 180, to permit resilient movement thereof toward and away from the housing's rear edge wall portion 180. And, the free end 196 of the spring 192 includes a latch portion 198 extending transversely therefrom.

Assuming the cartridge 112 (FIG. 2) is oriented relative to the receptacle 110 for insertion therein, the housing's opposed, lower, pointed, ridge edges 192 are oriented downwardly, and the housing's ridge edges, 186 and 188, are respectively vertically aligned with the receptacle's vertically oriented channel leg surfaces, 150 and 148. When the housing 164 is thus aligned with the receptacle 110, the free end 196 of the leaf spring 192 is located vertically above the inclined upper portion 140 of the receptacle's rear wall 116. As the cartridge 112 is gradually inserted into the receptacle 110, the ridge edges, 188 and 186, slidably engage the receptacle surfaces, 148 and 150, and the leaf spring 192 engages the receptacle's upper, inclined, rear wall portion 140 which gradually incrementally urges the leaf spring 194 towards housing's rear edge wall portion 180, causing energy to be gradually stored in the leaf spring 192 until the leaf spring's latch portion 198 slidably engages the receptacle lower rear wall portion 136. Thereafter, as the cartridge 112 is further lowered into the receptacle 110, the spring 192 releases sufficient energy to cause the latch portion 198 to be resiliently urged into the receptacle's lower rear wall portion aperture 138, for latching engagement therewith, to hold the cartridge 112 within the receptacle 110 against vertical movement out of the receptacle 112.

For further holding the cartridge 112 (FIG. 2) in the receptacle 110 and for guiding forward and rearward movement of the housing 164 within the receptacle 110, the housing 164 includes the aforesaid upper guide edges 190, and, in addition, the lower edge wall portion 176 of the housing 164 includes an elongate ridge 200 formed therein which is generally U-shaped in transverse cross-section. The ridge 200 longitudinally extends between the front and rear edge portions, 178 and 180, of the edge wall 174 and is located substantially midway between the opposed side walls 172. Moreover, the ridge 200 extends downwardly and outwardly of the housing 164, and has opposed, longitudinally-extending, side surfaces 252. When the cartridge 112 is sufficiently lowered into the receptacle 110, the housing's upper ridge edges 190 slidably engages the receptacle's upper lip surfaces 154, and the housing's lower edge portion 176 is disposed in sliding relationship with respect to the receptacle's base surfaces 132. Whereupon the cartridge leaf spring 192 releases sufficient stored energy to cause the leaf spring 192 to resiliently urge the housing 164 forwardly within the receptacle 110 until the housing's front edge portion 178 is urged into engagement with the receptacle's stop surfaces 156.

Assuming the cartridge 112 (FIG. 1) is mounted in the receptacle 110, as the postage printing structure 40 rotates into engagement with a letter 24 fed therebeneath, the drum 42 carries the printing die 44, in the circularly-extending path of travel 106 thereof, into engagement with the cartridge's transfer roller 168. In response to the printing die 44 engaging the transfer roller 168, the die 44 urges the housing 164 (FIG. 2) out of engagement with the receptacle stop surfaces 156 and rearwardly within the receptacle 112, against the forwardly directed resilient force exerted by the leaf spring 194. Thus the spring 194 resiliently urges the transfer roller 168 (FIG. 1) into engagement with the printing die 44 for transferring ink thereto from the transfer roller 168. And, in response to the printing die 44 rotating out of engagement with the transfer roller 168, the leaf spring 194 (FIG. 2) resiliently urges the housing 164 forwardly within the receptacle 110 and back into engagement with the receptacle's stop surfaces 156. As the housing 164 is thus reciprocably moved within the receptacle 110 in response to the printing die 44 (FIG. 1) engaging and disengaging the transfer roller 168, the housing's opposed ridge edges 190 (FIG. 2) slidably move against the receptacle's upper lip surfaces 154, and the housing's lower edge portion 176 slidably moves against the receptacle's lower wall base surfaces 132, for guiding movement of the housing 168 within the receptacle 110.

For manually removing the cartridge 112 (FIG. 2) from the receptacle 110, the housing's upper edge wall portion 174 has formed therein or marked thereon, an arrow 210 which directionally extends away from the housing's front edge wall portion 178 and towards the housing's rear edge wall portion 180, for visually indicating the direction in which the housing 164 is to be moved within the receptacle 110 for removing the cartridge 112 therefrom. In addition, the outer surface 212 of the housing's front edge wall portion 178 and the outer surface 214 of the leaf spring 192, each have formed therein a plurality of parallel-spaced, transversely-extending, ridges 216, which are serrated in transverse cross-section, to facilitate simultaneously manually grasping the housing 164 and leaf spring 192, and then resiliently urging the leaf spring latch portion 198 toward the housing's rear edge wall portion 180, for releasing the leaf spring 192 from the receptacle's lower rear wall aperture 138, and slidably moving the housing 164 rearwardly within the receptacle 110 until the housing's opposed upper ridge edges 190 are rearwardly moved out from beneath the receptacle's lip surfaces 154. Whereupon the cartridge 112 may be manually vertically raised out of the receptacle 110 for removal therefrom.

Figure 3:
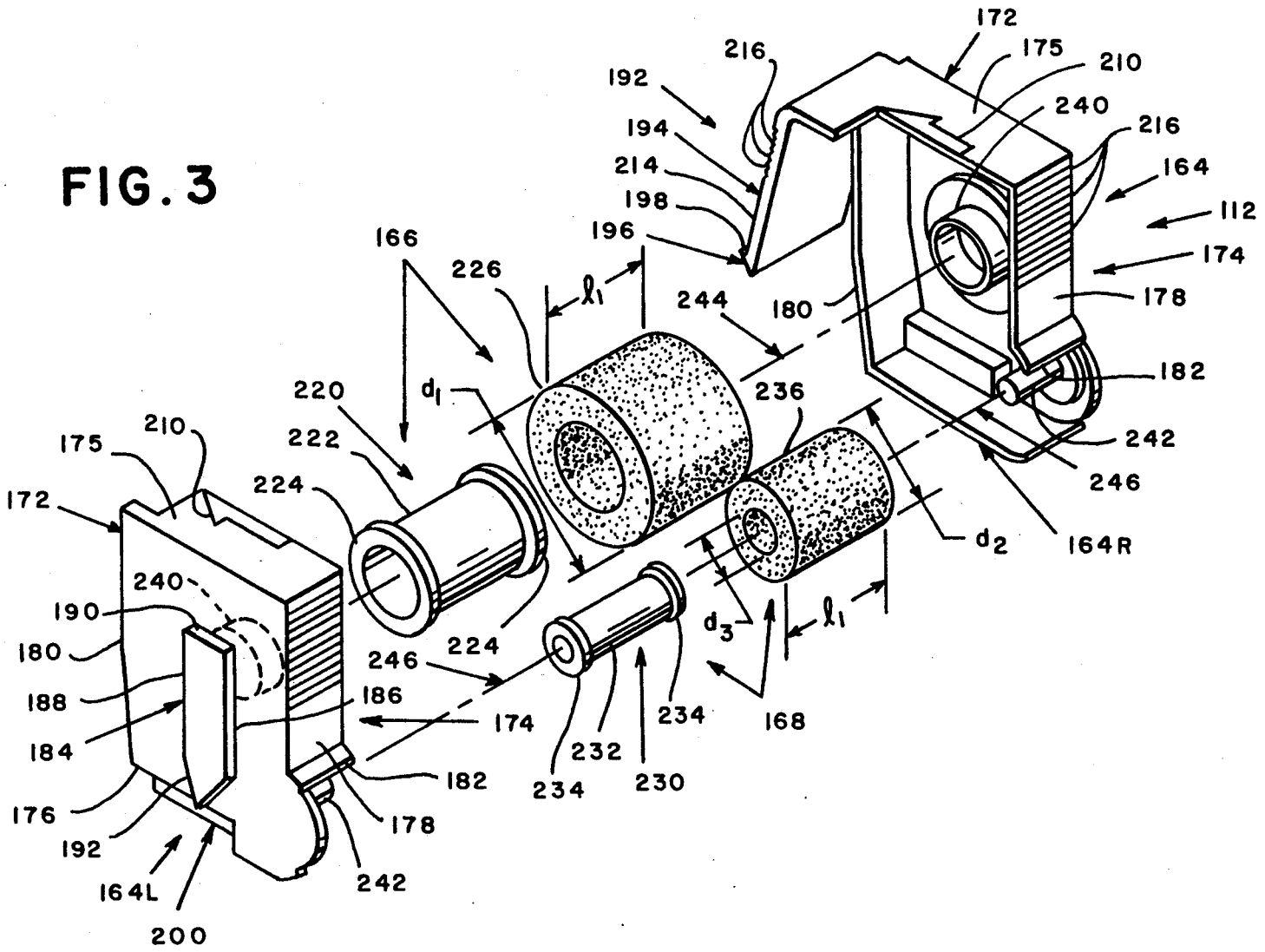
FIG. 3 is an exploded perspective view of the inking cartridge of FIG. 2.

As shown in FIG. 3, the reservoir roller 166 preferably includes an elongate, cylindrically-shaped inner spool 220, having a longitudinally-extending center portion 222 and oppositely-spaced shoulder portions 224, and includes an elongate, cylindrically-shaped outer member 226 which is coaxially mounted on the spool's center portion 222 between the shoulder portions 224. And the transfer roller 168 preferably includes an elongate, cylindrically-shaped inner spool 230, having a longitudinally-extending center portion 232 and oppositely-spaced shoulder portions 234, and includes an elongate, cylindrically-shaped outer member 236 which is coaxially mounted on the spool's center portion 232 between the shoulder portions 234. Preferably, the spools, 220 and 230, are molded from a plastic material such as polypropelene. Moreover, the the reservoir and transfer roller outer members, 226 and 236, are preferably made of a porous, ink impregnatable, foam material, such as polyurethane felted foam. Further, in the preferred embodiment, the reservoir and transfer roller outer members, 226 and 236, are preferably fabricated from the same piece of foam material. For example, the reservoir roller's outer member 226 is preferably fabricated by axially coring, as by means cutting, from a first solid cylinder of foam material, having an outer diameter $d_1$ and longitudinal length $l_1$ of the reservoir roller's outer member 226, a second solid cylinder of foam material, having an outer diameter $d_2$ and longitudinal length $l_1$ of the transfer roller's outer member 236. And the transfer roller's outer member 236 is preferably fabricated by axially coring, from the second solid cylinder, a third solid cylinder of foam material having an outer diameter $d_3$ of the inner diameter $d_3$ of the transfer roller's outer member 236. In any event, the reservoir and transfer roller outer members, 226 and 236, are preferably made of the same foam material and preferably have the same porosity.

Figure 2:
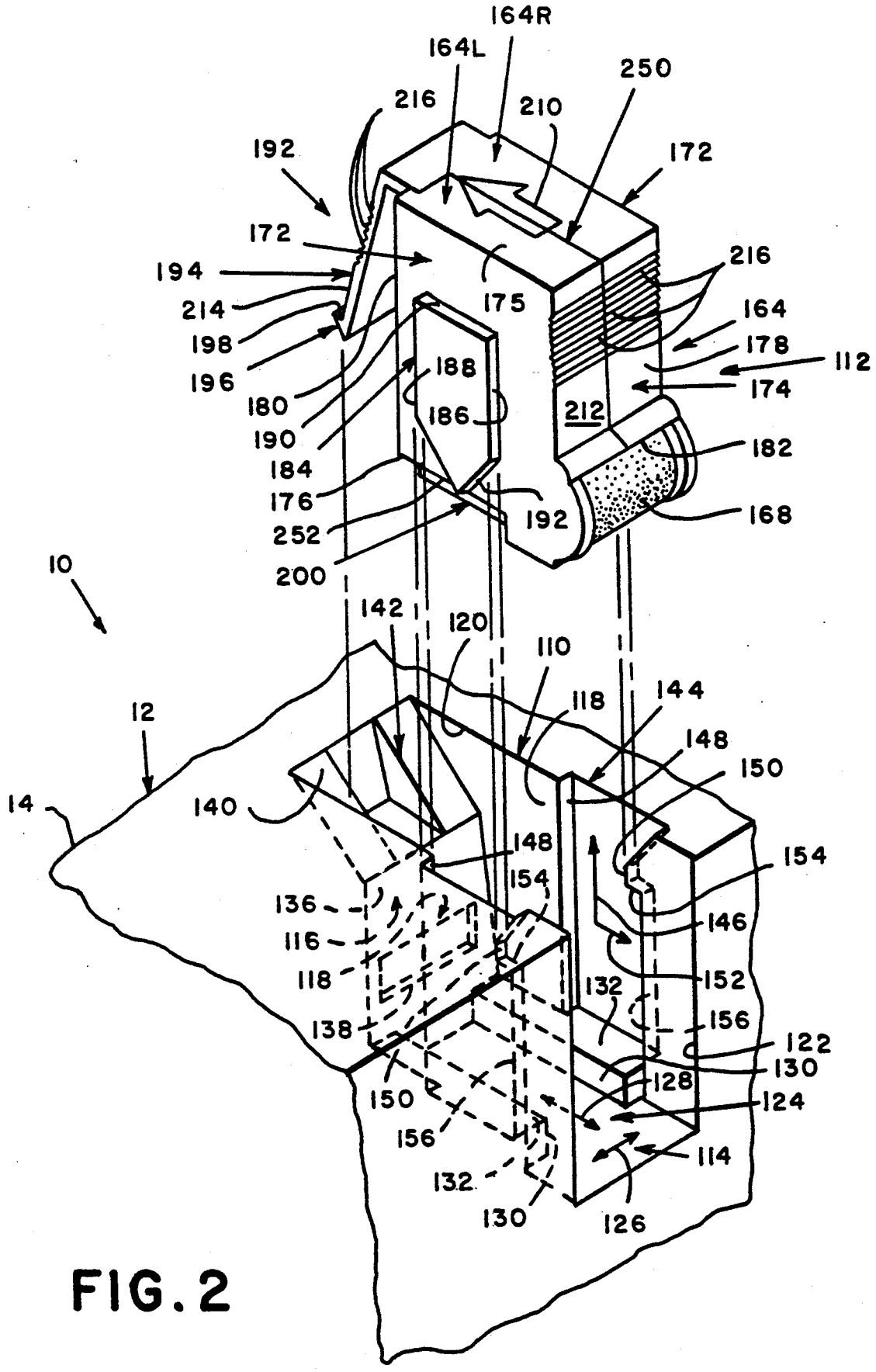
FIG. 2 is a partially fragmented, exploded, perspective view of the mailing machine of FIG. 1, showing the inking cartridge and a receptacle for removably receiving the cartridge.

As shown in FIG. 3, the housing 164 preferably includes oppositely facing left and right housing sections, 164L and 164R, as viewed from the housing's front edge wall portion 178 (FIG. 2). Each of the sections, 164L and 164R, is preferably molded from a crystalline, self-lubricating, plastic material, such as acetal, and includes one of the housing's opposed side walls 172 and substantially one-half of the housing's entire perimeter edge wall 174 (FIG. 2). As shown in FIG. 3, each of the side walls 172 preferably includes first and second, substantially cylindrically-shaped, hub portions, 240 or 242, which are integrally formed therewith so as to extend towards the opposite side wall 172, and, more particularly, toward the respective first and second hub portions, 240 or 242, thereof, so as to predetermine therewith a first axis 244 of rotation for the reservoir roller 166, and, parallel thereto, a second predetermined axis 246 of rotation for the transfer roller 168. Further, one of the housing's sections, 164L or 164R, for example, as shown in FIG. 3, the right section 164R, preferably has integrally formed therewith the entire leaf spring 192 for the cartridge 112.

For assembling the cartridge 112 (FIG. 3), the outer members, 226 and 236, may initially be respectively mounted on the spools, 220 and 230, followed by coaxially mounting the reservoir and transfer roller spools, 220 and 230, on the respective hub portions, 240 and 242, of a selected one of housing sections, 164R or 164L. Whereupon the other housing section, 164R or 164L, as the case may be, may be assembled with the selected housing section, 164L or 164R, in a manner such that the hub portions, 240 and 242, thereof are coaxially disposed within the free ends of the respective spools, 220 and 230, followed by fixedly attaching, as by welding, the seam 250 (FIG. 2) defined by the assembled housing sections, 164L and 164R. As thus constructed and arranged, one of the shoulder portions, 224 and 234 (FIG. 3), of each of the reservoir and transfer roller spools, 220 and 230, is disposed in bearing engagement with a different one of the left or right housing sections, 164L or 164R, for rotation thereagainst and for holding the associated ink impregnated outer member, 226 or 236, out of engagement therewith. Further, as thus preferably constructued and arranged the housing 164 is a weldment containing the reservoir and transfer rollers, 166 and 168, therewithin to form a disposable inking cartridge 112.

In accordance with the objects of the invention there has been described an inking cartridge and, more particularly, a disposable inking cartridge adapted to be removably connected to a mailing machine for use therein.

What is claimed is:

1. A disposable inking cartridge adapted to be removably connected to a mailing machine, the cartridge comprising:

a. a generally rectangularly-shaped hollow housing having opposed side walls and having an edge wall extending between the side walls, the walls defining an aperture formed in the housing;

b. an ink impregnated reservoir roller extending between the side walls and supported thereby for rotation about a first predetermined axis;

c. an ink impregnated transfer roller extending between the side walls and supported thereby for rotation about a second predetermined axis extending parallel to the first axis; and d. the reservoir and transfer rollers respectively dimensioned for rolling engagement with each other to cause ink from the reservoir roller to be transferred to the transfer roller, and the transfer roller disposed within the housing to permit peripheral access thereto via the housing aperture;

wherein each of the side walls includes first and second cylindrically-shaped hub portions integrally formed therewith so as to respectively bend toward the opposite side wall, the first hub portions supporting the reservoir roller and predetermining the first axis, and the second hub portions supporting the transfer roller and predetermining the second axis.

2. A disposable inking cartridge adapted to be removably connected to a mailing machine, the cartridge comprising:

a. a generally rectangularly-shaped hollow housing having opposed side walls and having an edge wall extending between the side walls, the walls defining an aperture formed in the housing;

b. an ink impregnated reservoir roller extending between the side walls and supported thereby for rotation about a first predetermined axis;

c. an ink impregnated transfer roller extending between the side walls and supported thereby for rotation about a second predetermined axis extending parallel to the first axis; and d. the reservoir and transfer rollers respectively dimensioned for rolling engagement with each other to cause ink from the reservoir roller to be transferred to the transfer roller, and the transfer roller disposed within the housing to permit peripheral access thereto via the housing aperture;

wherein each of the rollers includes a cylindrically-shaped inner spool and a cylindrically-shaped outer member coaxially mounted thereon, and the spools respectively rotatably supported by the opposite side walls.

3. The cartridge according to claim 2, wherein the respective outer members are made of polyurethane felted foam.

4. The cartridge according to claim 2, wherein the respective outer members are impregnated with printing ink.

5. The cartridge according to claim 2, wherein each of the spools includes a longitudinally-extending center portion and opposed shoulder portions, the outer member of each roller is coaxially mounted on the spool center portion thereof between the shoulder portions thereof, and the opposed shoulder portions of each spool are each disposed in bearing engagement with a different one of the opposed housing side walls.

6. The cartridge according to claim 2, wherein each of the roller outer members is fabricated from the same foam material.

7. The cartridge according to claim 2, wherein each of the roller outer members is made from a felted foam material, and each of the roller outer members has substantially the same porosity as the other outer member.

8. A disposable inking cartridge adapted to be removably connected to a mailing machine, the cartridge comprising:

a. a generally rectangularly,shaped hollow housing having opposed side walls and having an edge wall extending between the side walls, the walls defining an aperture formed in the housing;

b. an ink impregnated reservoir roller extending between the side walls and supported thereby for rotation about a first predetermined axis;

c. an ink impregnated transfer roller extending between the side walls and supported thereby for rotation about a second predetermined axis extending parallel to the first axis; and d. the reservoir and transfer rollers respectively dimensioned for rolling engagement with each other to cause ink from the reservoir roller to be transferred to the transfer roller, and the transfer roller disposed within the housing to permit peripheral access thereto via the housing aperture;

e. an elongate leaf spring integrally formed with and extending from the housing and alongside of a portion of the edge wall thereof.

9. A disposable inking cartridge adapted to be removably connected to a mailing machine, the cartridge comprising:

a. a generally rectangularly-shaped hollow housing having opposed side walls and having an edge wall extending between the side walls, the walls defining an aperture formed in the housing;

b. an ink impregnated reservoir roller extending between the side walls and supported thereby for rotation about a first predetermined axis;

c. an ink impregnated transfer roller extending between the side walls and supported thereby for rotation about a second predetermined axis extending parallel to the first axis; and d. the reservoir and transfer rollers respectively dimensioned for rolling engagement with each other to cause ink from the reservoir roller to be transferred to the transfer roller, and the transfer roller disposed within the housing to permit peripheral access thereto via the housing aperture;

wherein the edge wall includes oppositely spaced upper and lower portions, the edge wall including a side portion extending between the upper and lower portions, and the cartridge including a leaf spring extending from the housing and alongside of the side portion thereof.

10. The cartridge according to claim 9, wherein the lower edge portion includes an elongate ridge formed therein and having a generally U-shaped transverse cross-section.

11. A disposable inking cartridge adapted to be removably connected to a mailing machine, the cartridge comprising:

a. a generally rectangularly-shaped hollow housing having opposed side walls and having an edge wall extending between the side walls, the walls defining an aperture formed in the housing;

b. an ink impregnated reservoir roller extending between the side walls and supported thereby for rotation about a first predetermined axis;

c. an ink impregnated transfer roller extending between the side walls and supported thereby for rotation about a second predetermined axis extending parallel to the first axis; and d. the reservoir and transfer rollers respectively dimensioned for rolling engagement with each other to cause ink from the reservoir roller to be transferred to the transfer roller, and the transfer roller disposed within the housing to permit peripheral access thereto via the housing aperture;

wherein the housing is a weldment fabricated from opposed sections thereof which each include a different one of the side walls, and the cartridge including spring means extending from one of the sections.

12. The cartridge according to claim 11, wherein the spring means includes a leaf spring integrally formed with the one housing section.

* * * * *